US006603942B2

(12) United States Patent
Asuwa et al.

(10) Patent No.: US 6,603,942 B2
(45) Date of Patent: Aug. 5, 2003

(54) IMAGE FORMING APPARATUS HAVING BELT-SHAPED CARRIER

(75) Inventors: Kenji Asuwa, Toride (JP); Kazutaka Sato, Kashiwa (JP); Masahiro Yagi, Chiyoda (JP); Isao Nakajima, Hitachinaka (JP); Yukio Otome, Tokai (JP); Akihiko Yamazaki, Hitachinaka (JP)

(73) Assignees: Hitachi, Ltd., Tokyo (JP); Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/216,725

(22) Filed: Aug. 13, 2002

(65) Prior Publication Data

US 2003/0068175 A1 Apr. 10, 2003

(30) Foreign Application Priority Data

Oct. 4, 2001 (JP) ..... 2001-308147

(51) Int. Cl.[7] ..... G03G 15/00
(52) U.S. Cl. ..... 399/162

(58) Field of Search ..... 399/162, 164, 399/165; 474/112; 198/814, 840

(56) References Cited

FOREIGN PATENT DOCUMENTS

JP 05297726 A * 11/1993 ..... G03G/15/00
JP 2000018370 A * 1/2000 ..... G03G/15/00

* cited by examiner

*Primary Examiner*—Sophia S. Chen
*Assistant Examiner*—Ryan Gleitz
(74) *Attorney, Agent, or Firm*—Antonelli, Terry, Stout & Kraus, LLP

(57) ABSTRACT

An image forming apparatus has an endless belt which serves as an image carrier is characterized by reduced image misregistration and reduced machining cost. When the endless belt feed path is divided into a path from a drive roller to a tension roller, and a path from the tension roller to the drive roller, the eccentricity of an idle roller located on the path on the side including a latent image forming point is set to a value smaller than that of an idle roller located on the path not including the image forming point.

7 Claims, 3 Drawing Sheets

IMAGE FORMING APPARATUS HAVING BELT-SHAPED CARRIER

BACKGROUND OF THE INVENTION

The present invention relates to an image forming apparatus.

An image forming apparatus is a device in which an electric charge is applied to an image carrier, such as a photoconductor, and a latent image is formed by removing this electric charge from selected areas of the photoconductor surface using an exposure apparatus, such as a laser or a light emitting diode. Further, in this device, a visible image is obtained by causing a toner to attach to the charged positions in this latent image using a development apparatus. Such an apparatus is an electrophotographic printing type image forming apparatus, which has come into common use in recent years.

This electrophotographic printing type image forming apparatus uses an endless belt, that is driven in circulation, as an image carrier.

This endless belt provides a higher degree of freedom with respect to the layout of the exposure apparatus, development apparatus and other apparatuses that are mounted therewith, and the use of such an endless belt makes it possible to downsize the image forming apparatus.

The endless belt is supported by multiple rollers. Such rollers generally comprises a drive roller for applying a drive force to the belt, a tension roller for adding tension to ensure stable belt feed, and multiple idle rollers for defining the belt feed path.

The above-stated rollers have a predetermined inherent eccentricity in conformity to the machining accuracy thereof. Such eccentricity causes fluctuation of the belt feed speed and misregistration in the image formation, and, hence, image distortion occurs, resulting in a considerable deterioration of the image quality. Furthermore, in a color image forming apparatus for forming a multicolor image through overlay of multiple monochromatic toner images, a misregistration in color overlay can be caused by roller eccentricity, resulting in a considerable deterioration of the image quality.

The above-stated problems are not limited to the image carrier. The same problems are found in an intermediate transfer member such as used in a so-called intermediate transfer member type image forming apparatus, wherein an image is formed on a recording medium after a toner image that has been formed on the image carrier has been transferred onto a belt-shaped intermediate transfer member.

The misregistration of an image caused by roller eccentricity can be reduced by keeping the eccentricity within a predetermined range through a high precision machining of a roller. However, improved machining accuracy involves higher machining cost. For this reason, application of this principle has been limited.

To solve this problem, various proposals have been made involving techniques for meeting the required image level without depending on high roller machining accuracy. For example, Japanese Application Patent Laid-Open Publication No. Hei 08-137153 discloses a method wherein a value obtained by subtracting a predetermined value from the distance between the exposure point and the transfer point is defined as an integral multiple of the peripheral length of a drive roller, whereby the influence of image misregistration on the belt-shaped image carrier, resulting from roller eccentricity, is cancelled on the transfer member.

SUMMARY OF THE INVENTION

However, the above-stated technique has been intended to solve the problem of deterioration in image quality caused by the eccentricity of a drive roller. No action has been taken for dealing with the eccentricity of idle rollers that are commonly provided in multiple numbers. Accordingly, when the above-stated technique is adopted, it is necessary to machine all idle rollers to an accuracy sufficient to ensure that a predetermined level of eccentricity is not exceeded. However, this directly results in higher production costs.

The object of the present invention is to provide an image forming apparatus that is free from image misregistration and can be economically produced.

The foregoing object of the present invention can be achieved by an image forming apparatus comprising a belt-shaped carrier that is supported on a drive roller, multiple idler rollers and a tension roller; a latent image forming apparatus mounted on the belt-shaped carrier; a developing apparatus for applying toner on a latent image formed by the latent image forming apparatus; and a transfer apparatus for transferring the toner image formed by the developing apparatus.

The above-described image forming apparatus is further characterized in that, when a path leading from the drive roller to the tension roller in the forward direction of movement of the belt-shaped carrier is defined as a drive roller downstream path, and a path leading from the tension roller to the drive roller is defined as a drive roller upstream path, the amount of eccentricity of any idle roller located on the drive roller downstream path is made smaller than that of any idle roller located on the drive roller upstream path, where the latent image forming apparatus is arranged on the drive roller downstream path.

The foregoing object of the present invention can also be achieved by an image forming apparatus, as described above, which is characterized in that, when a path leading from the drive roller to the tension roller in the forward direction of movement of the belt-shaped carrier is defined as a drive roller downstream path, and a path leading from the tension roller to the drive roller is defined as a drive roller upstream path, the amount of eccentricity of any idle roller located on the drive roller upstream path is made smaller than that of any idle roller located on the drive roller downstream path, where the latent image forming apparatus is arranged on the drive roller upstream path.

The foregoing object of the present invention can also be achieved by an image forming apparatus, as described above, that is characterized in that, when the radius of the idle roller is "r", the eccentricity thereof is "e", the winding angle thereof θ[rad] and the maximum permissible misregistration is "d", the eccentricity "e" of the idle roller, that is arranged on the path that includes the position on which the latent image forming apparatus, is located, is expressed as $e<d(\theta/\pi)$.

The foregoing object of the present invention can also be achieved by an image forming apparatus, as described above, that is characterized in that the eccentricity of the idle roller having a greater winding angle of the belt-shaped carrier is smaller than that of the idle roller having a smaller winding angle.

The foregoing object of the present invention can also be achieved by an image forming apparatus comprising a belt-shaped intermediate transfer member that is supported on a drive roller, multiple idler rollers and a tension roller, multiple monochromatic image forming means mounted on the belt-shaped intermediate transfer member; a first transfer apparatus for transferring, to the belt-shaped intermediate transfer member, a plurality of monochromatic toner images formed by the multiple monochromatic image forming means; and a second transfer apparatus for transferring, to a recording medium, a colored image obtained by overlaying the plurality of monochromatic toner images.

The above-described image forming apparatus is further characterized in that, when a path leading from the drive roller to the tension roller in the forward direction of movement of the belt-shaped carrier is defined as a drive roller downstream path, and a path leading from the tension roller to the drive roller is defined as a drive roller upstream path, the amount of eccentricity of any idle roller located on the drive roller downstream path is made smaller than that of any idle roller located on the drive roller upstream path, where the latent image forming apparatus is arranged on the drive roller downstream path.

The foregoing object of the present invention can also be achieved by an image forming apparatus, as described above, which is characterized in that, when a path leading from the drive roller to the tension roller in the forward direction of movement of the belt-shaped carrier is defined as a drive roller downstream path, and a path leading from the tension roller to the drive roller is defined as a drive roller upstream path, the amount of eccentricity of any idle roller located on the drive roller upstream path is made smaller than that of the idle roller located on the drive roller downstream path, where the latent image forming apparatus is arranged on the drive roller upstream path.

The foregoing object of the present invention can also be achieved by an image forming apparatus, as described above, that is characterized in that, when the radius of the idle roller is "r", the eccentricity thereof is "e", the winding angle thereof is $\theta$[rad] and the maximum permissible misregistration is "d", the eccentricity "e" of the idle roller, that is arranged on the path that includes the position on which the transfer point is located, is expressed as $e<d(\theta/\pi)$.

The foregoing object can also be achieved by an image forming apparatus characterized in that the eccentricity of the idle roller having a greater winding angle of the belt-shaped intermediate transfer member is smaller than that of the idle roller having a smaller winding angle.

The foregoing object of the present invention of the present invention can also be achieved by an image forming apparatus as described above, wherein a support member is provided for supporting the tension roller rotating shaft in a linearly movable manner, and the support member comprises an elastic member.

The above-described image forming apparatus is further characterized in that, when the peripheral length of the belt-shaped carrier or intermediate transfer member is "1", the width is "w", the thickness is "t", Young's modulus is "E", the total of the eccentricities of all rollers which support the belt-shaped carrier or intermediate transfer member is "$\Sigma e$", the maximum permissible image position misregistration is "d" and the angles formed by the tension roller traveling direction and the upstream and downstream paths of the belt-shaped carrier or intermediate transfer member is $\alpha$ and $\beta$, then the spring constant k of the elastic member can be expressed as $k<wtE(\cos\alpha+\cos\beta)d/(1\Sigma e)$.

DETAILED DESCRIPTION OF THE INVENTION

Various embodiments of the present invention will be described with reference to the drawings.

Figure 1:
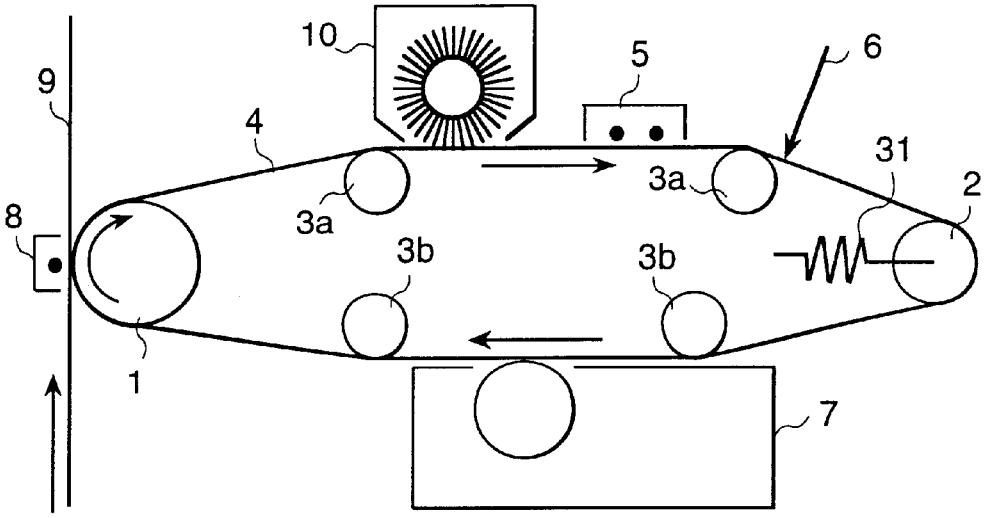
FIG. 1 is a diagram representing the configuration of an image forming apparatus according to a first embodiment of the present invention.

FIG. 1 shows an image forming apparatus comprising a first embodiment of the present invention.

In FIG. 1, numeral 4 denotes an endless image carrier in the form of a photosensitive belt, which is supported by a drive roller 1, a tension roller 2 coupled to tension roller shaft displacement means 31 for supporting the tension roller 2 in a linearly movable manner, and idle rollers 3*a* and 3*b*.

An electric charging apparatus 5, a latent image forming apparatus 6 comprising a laser or a light emitting diode, a development apparatus 7, a transfer apparatus 8 and a cleaner 10 are arranged around the periphery of the endless image carrier.

An image is formed by the image forming apparatus according to the following steps.

First, the outer surface of the image carrier 4 is uniformly electrically charged by the electric charging apparatus 5. As seen in the figure, the electric charge on the surface of the image carrier 4, which is rotating in the direction of the arrows, is removed selectively by the latent image forming apparatus 6 at image position conforming to the input data, whereby a latent image is formed on the surface of the image carrier 4. Then, the development apparatus 7 applies toner to the site where the latent image has been formed, thereby forming a toner image. After that, the toner image is transferred to the recording medium 9, such as a sheet of recording paper, by the transfer apparatus 8. The toner image is then fixed on the recording medium 9 by a fixing apparatus (not illustrated) in the final stage in which the image forming process terminates.

Figure 2A:
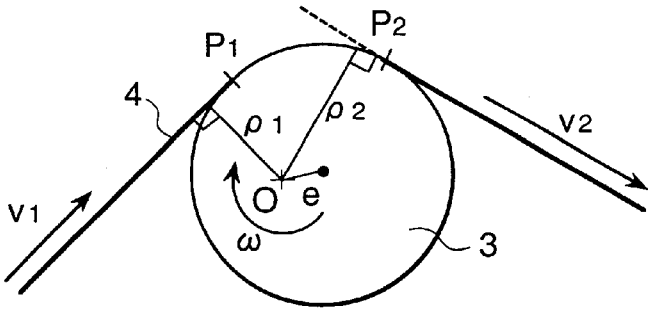
FIGS. 2(*a*) and 2(*b*) are diagrams illustrating the mechanism for producing belt speed fluctuation based on the use of eccentric idle rollers.
Figure 2B:
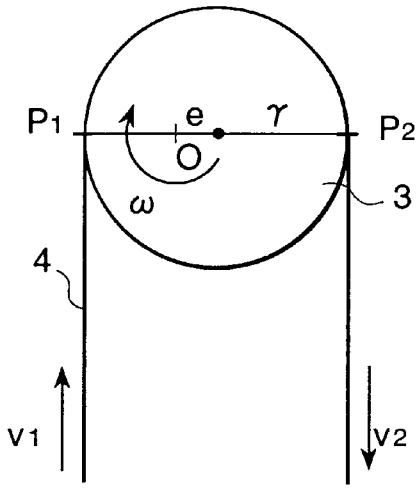

In the belt-shaped image carrier, which is supported by multiple rollers (hereinafter simply referred to as a "belt"), as described above, the inherent eccentricity of the idle rollers 3*a* and 3*b* causes fluctuation in the belt speed. FIG. 2(*a*) shows such fluctuation of the belt-shaped image carrier speed in the areas before and after the position where a given idle roller 3 is eccentric.

In FIG. 2(*a*), the relationship among the distance $\rho_i$ from rotation center O to the belt on the upstream side, the instantaneous speed $v_1$ of the belt on the upstream side and the instantaneous angular speed $\omega$ of the idle roller can be expressed as $\omega=v_1/\rho_1$. Meanwhile, the relationship among the distance $\rho_2$ from rotation center O to the belt on the downstream side, the instantaneous speed $v_2$ of the belt on the downstream side and $\omega$ can be expressed as $\omega=v_2/\rho_2$. Thus, the relationship between instantaneous speed $v_1$ of the belt on the upstream side and instantaneous speed $v_2$ of the belt on the downstream side can be expressed as $v_2=(\rho_2/\rho_1)v_1$.

This means that there is always a speed difference between the belts on the upstream and downstream sides of the roller when $\rho_2$ is not equal to $\rho_1$, namely, when the idle roller is eccentric. In particular, $\rho_1$ and $\rho_2$ undergo periodic fluctuation with the rotation of the idle roller, and this is the cause for the fluctuation in speed.

FIG. 2(*b*) shows the case of a winding angle $\theta=\pi$[rad] where the belt speed difference is the greatest before and after the idle roller 3.

In FIG. 2(*b*), assume that the average belt speed is "v", the idle roller radius is "r", the eccentricity is "e" and the average angular speed is "ω". Then we get ω=v/r. Since $\rho_1=r-e$ and $\rho_2=r+e$, the amplitude of the belt speed fluctuation is eω. The belt speed $\delta v_{max}$ in this case can be expressed approximately as follows:

$$\delta v_{max}=e\omega \sin \omega\tau$$

Here τ denotes time.

The speed fluctuation is proportional to the belt winding angle, so that the speed fluctuation δv for the belt having a winding angle of θ is as follows:

$$\delta v=e\omega(\theta/\pi)\sin \omega\tau$$

Thus, the greater the belt winding angle, the greater the speed fluctuation before and after the idle roller.

In this case, the color misregistration resulting from the speed fluctuation can be obtained as follows:

$$\int\{\delta v\}d\tau=e\omega(\theta/\pi)(1/\omega))\cos \omega t$$

The amplitude of e(ω/π) is obtained.

The propagation of the above-stated speed fluctuation will now be described with reference to FIG. 3.

Figure 3:
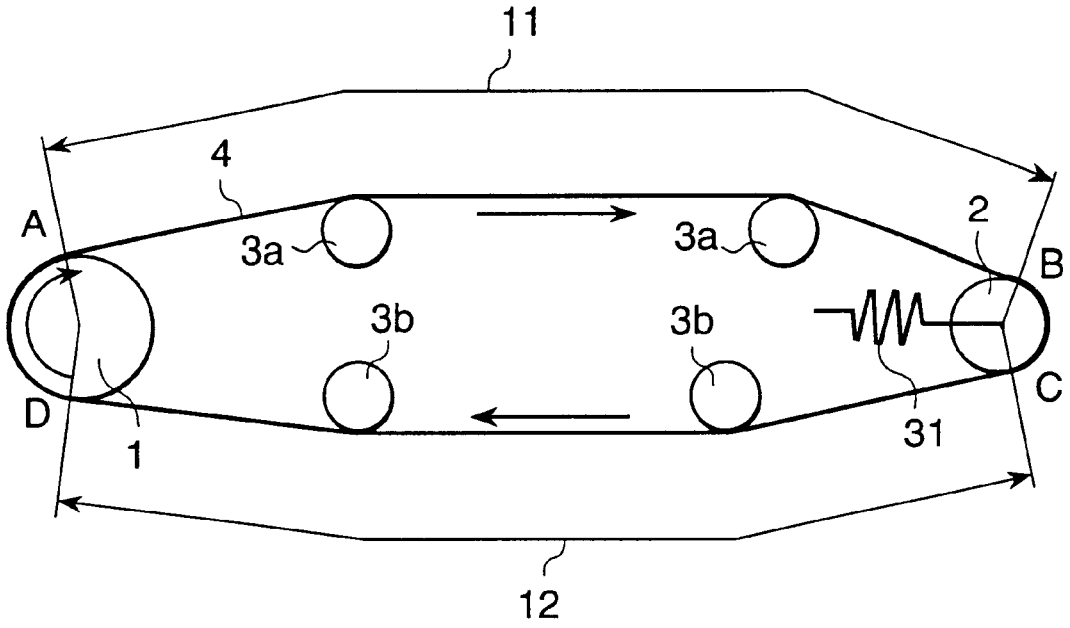
FIG. 3 is a diagram defining the belt path.

In FIG. 3, the belt speed fluctuation resulting from idle roller eccentricity is considered to come from the influence of the position fluctuation caused by the eccentricity. When the belt does not extend or contract, the influence of the position fluctuation is absorbed by the movement of the tension roller 2 caused by the action of the tension roller rotation shaft support means 31.

Assume that, of the belt feed paths, the path leading from the drive roller 1 to the tension roller 2 is defined as a drive roller downstream path 11, and the path leading from the tension roller 2 to the drive roller 1 is defined as a drive roller upward path 12. Then, the fluctuation of the position caused by the eccentricity of the idle roller 3*a*, which is located on the drive roller downstream path 11, is not transmitted to the drive roller upstream path 12. The fluctuation of the position caused by the eccentricity of the idle roller 3*b*, which is located on the drive roller upstream path 12, is not transmitted to the drive roller downstream path 11.

In other words, when the belt path is divided into a drive roller upstream path 12 and a drive roller downstream path 11, the fluctuation of the speed caused by an idle roller located on one path is not transmitted to the other path. Accordingly, image misregistration is affected if there is eccentricity in the idle roller located on either the drive roller upstream path 12 or the drive roller downstream path 11, when a latent image is formed on that path. However, image misregistration is not affected by the eccentricity of the roller located on the path where a latent image is not formed.

The present invention is based on the above-mentioned phenomenon and to make a selective arrangement of the rollers with a smaller eccentricity in the path where a latent image is formed, thereby maintaining the required image quality and reducing the production cost.

In the embodiment shown in FIG. 1, the amount of eccentricity of the idle rollers 3*a*, located on the above-referenced drive roller downstream path, is made smaller than that of the idle rollers 3*b* that are located on the drive roller upstream path. The latent image processing apparatus is arranged on the drive roller downstream path. Thus, image misregistration is not affected by the idle rollers 3*b* that are located on the upstream path, as described above.

This arrangement reduces the image misregistration resulting from the eccentricity of idle rollers, with the result that there is no need for high-precision machining of the idle rollers 3*b*, and so production costs are reduced by a corresponding amount.

Figure 4:
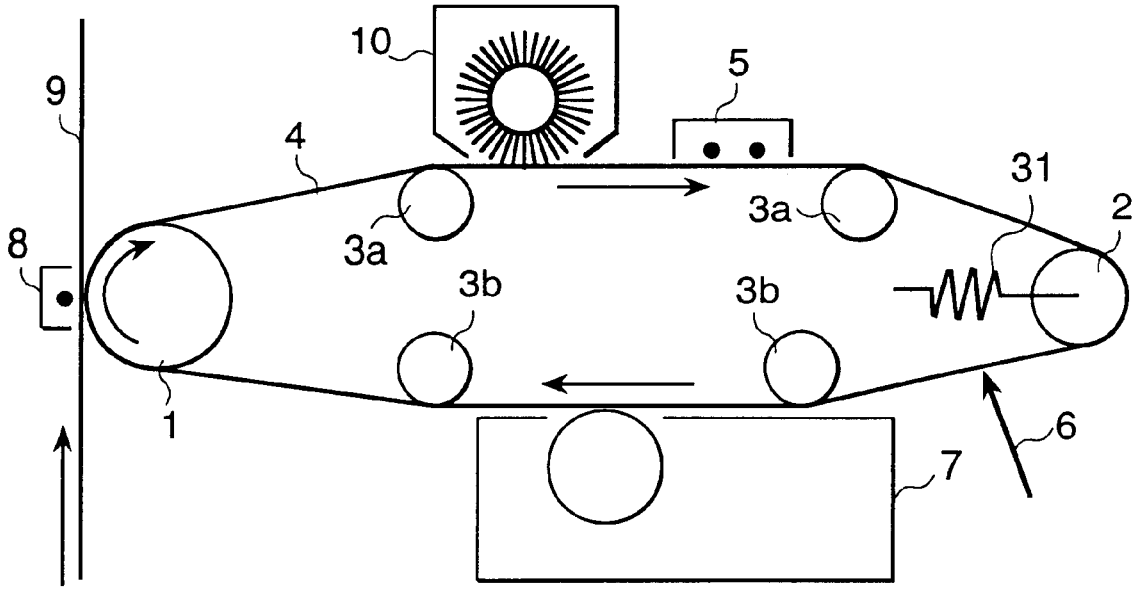
FIG. 4 is a diagram representing another configuration of the image forming apparatus according to the first embodiment of the present invention.

FIG. 4 is a diagram representing another embodiment of the image forming apparatus related to the first embodiment according to the present invention.

In FIG. 4, the amount of eccentricity of the idle roller 3*b* that are located on the a drive roller upstream path is made smaller than that of the idle rollers 3*a* located on the drive roller downstream path, and the above-described latent image processing apparatus is arranged on the drive roller downstream path.

In contrast to the embodiment illustrated in FIG. 1, the latent image forming apparatus 6 in the embodiment of FIG. 4 is located on the upstream side of the drive roller. This ensures that image misregistration will not be affected by the idle rollers 3*a* located on the drive roller downstream path. Thus, the image misregistration resulting from idle roller eccentricity can be reduced, with the result that there is no need for high-precision machining of the idle rollers 3*a*, and so production costs are reduced by a corresponding amount.

Furthermore, rational cost reduction is ensured by setting the idle rollers, that are arranged on the path that includes the position of the latent image forming apparatus 6, in such a way that the eccentricity of the idle rollers having a greater belt winding angle is smaller than that of the idle rollers having a smaller belt winding angle.

Generally, stable belt feed requires tension to be given to the belt. Belt extension and contraction results when tension is applied to the belt, but the image quality can be maintained if the extension of the belt δλ resulting from the fluctuation of tension δT, subsequent to application of the tension required for stable feed, is kept below the permissible maximum image misregistration "d". Assuming that the belt peripheral length is "1", the width "w", the thickness "t" and Young's modulus "E", then tension fluctuation δT is expressed as $\delta T=(wtE\delta\lambda)/1$.

In this case, the force "dF"acting on the elastic member provided on the tension roller shaft supporting member is given as $\delta F=k\delta x$, where the spring constant of the elastic member is "k" and the displacement thereof is "δx".

Figure 5:
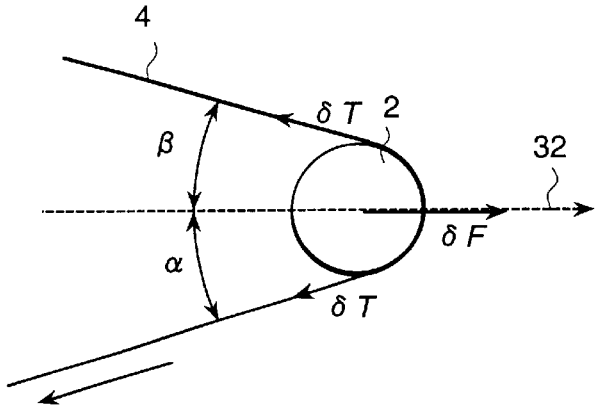
FIG. 5 is a diagram representing the positional relationship between a tension roller and belt.

When the tension roller travels in the direction shown by the arrow 32 in FIG. 5, and angles formed between the traveling direction, and the drive roller upstream path and the drive roller downstream path are α and β, respectively, the above-stated values of T and F are related to each other as follows:

$$\delta F=(\cos \alpha+\cos \beta)\delta T$$

Here, the image misregistration can be kept below the permissible value "d" when δλ<d. If consideration is given to the fact that the displacement δx of the elastic member is equivalent to the total of all the roller eccentricities Σe at most, then the above-stated relationship can be met when the spring constant k of the elastic member satisfies the following relationship:

$$k<wtE(\cos \alpha+\cos \beta)d/(1\Sigma e)$$

In this case, image misregistration can be kept below the permissible value.

Figure 6:
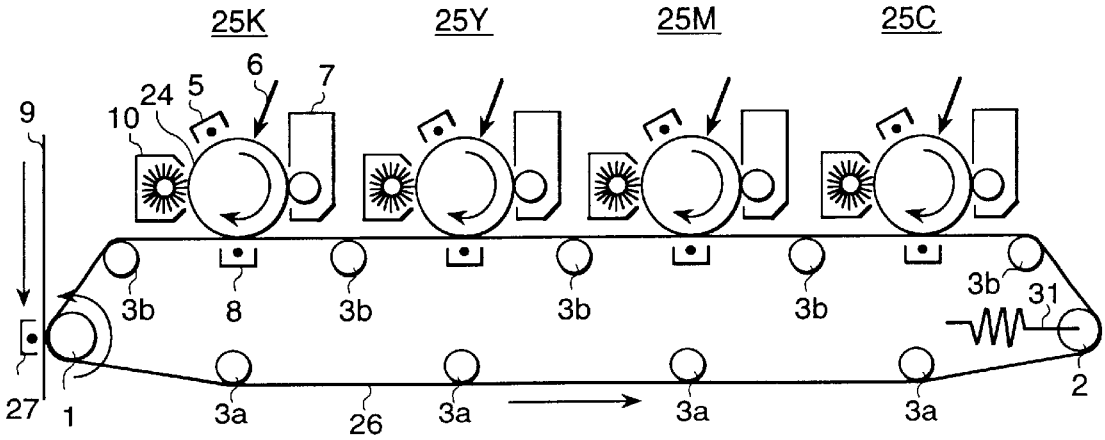
FIG. 6 is a diagram representing a further configuration of an image forming apparatus according to a second embodiment of the present invention.

FIG. 6 is a diagram an image forming apparatus representing a further embodiment of the present invention.

As seen in FIG. 6, this apparatus comprises monochromatic image forming means 25K, 25Y, 25M and 25C, for forming monochromatic toner images of black, yellow, magenta and cyan, respectively, and a belt shaped intermediate transfer member 26 that is supported by drive roller 1, tension roller 2 and idle rollers 3*a* and 3*b*. Each of the image forming means 25K, 25Y, 25M and 25C comprises an electric charging apparatus 5, a latent image forming apparatus 6 consisting of a laser and light emitting diode, a development apparatus 7, a transfer apparatus 8 and a cleaner 10, arranged around the periphery of a drum-shaped image carrier 24.

In the image forming apparatus of FIG. 6, the monochromatic toner images, that are formed by the image forming means 25K, 25Y, 25M and 25C, are transferred onto the belt-shaped intermediate transfer member 26 by a respective transfer apparatus 8, so that the toner images are overlaid one on top of another, thereby forming a color image. The color image formed in this way is transferred onto the recording medium 9, such as a sheet of recording paper, by a transfer apparatus 27, and the color image is fixed on the recording medium 9 by a fixing apparatus (not illustrated) in the final stage.

In this image forming apparatus, the image position is determined at the transfer point where an image is transferred from the monochromatic image forming means to the intermediate transfer member.

As described above, in the image forming apparatus shown in FIG. 6, the transfer point is located on the drive roller upstream path. Accordingly, the image misregistration resulting from idle roller eccentricity can be reduced if the amount of eccentricity of the idle rollers 3*b*, that are located on the drive roller upstream path, is made smaller than that of the idle rollers 3*a* that are located on the drive roller downstream path. This arrangement will reduce the cost that would be required by high precision machining of the idle rollers 3*a*.

Conversely, when the transfer point is located on the driver roller downstream path, the image misregistration resulting from idle roller eccentricity can be reduced if the amount of eccentricity of the idle rollers 3*a*, that are located on the drive roller downstream path, is made smaller than that of the idle rollers 3*b* that are located on the drive roller upstream path. This arrangement will reduce the cost that would be required by high precision machining of the idle rollers 3*b*.

Furthermore, rational cost reduction is ensured by setting the idle roller, that is arranged on the path including the transfer point, in such a way that the eccentricity of the idle roller having a greater belt winding angle is smaller than that of the idle roller having a smaller belt winding angle.

FIG. 6 shows an example of the so-called tandem type color image forming apparatus comprising multiple monochromatic image forming means equipped with drum-shaped image carriers. The present invention, however, is not restricted thereto. A belt-shaped image carrier may be used in the monochromatic image forming means, or a monochromatic image forming apparatus equipped with single monochromatic image forming means may be utilized.

Furthermore, FIG. 6 shows a configuration which uses an intermediate transfer member. A configuration with a paper fed belt, instead of the intermediate transfer member, is also possible.

The present invention provides an image forming apparatus that is further characterized in that image misregistration resulting from idle roller eccentricity is reduced and high precision machining of all multiple idle rollers is unnecessary, whereby excellent image quality and reduced machining costs are ensured.

What is claimed is:

1. An image forming apparatus, comprising:

a belt-shaped carrier supported for movement on a drive roller, multiple idler rollers and a tension roller;

a latent image forming apparatus mounted on said belt shaped carrier;

a developing apparatus for applying toner on a latent image formed by said latent image forming apparatus on said belt-shaped carrier; and a transfer apparatus for transferring the toner image formed by said developing apparatus;

wherein, when a path leading from said drive roller to said tension roller in a forward direction of movement of said belt-shaped carrier is defined as a drive roller downstream path, and a path leading from said tension roller to said drive roller is defined as a drive roller upstream path, the amount of eccentricity of any idle roller located on said drive roller downstream path is made smaller than that of the idle roller located on said drive roller upstream path, and wherein said latent image forming apparatus is arranged on said drive roller downstream path.

2. An image forming apparatus, comprising:

a belt-shaped carrier supported for movement on a drive roller, multiple idler rollers and a tension roller a latent image forming apparatus mounted on said belt shaped carrier;

a developing apparatus for applying toner on a latent image formed by said latent image forming apparatus on said belt-shaped carrier; and a transfer apparatus for transferring the toner image formed by said developing apparatus;

wherein, when a path leading from said drive roller to said tension roller in a forward direction of movement of said belt-shaped carrier is defined as a drive roller downstream path, and a path leading from said tension roller to said drive roller is defined as a drive roller upstream path, the amount of eccentricity of any idle roller located on said drive roller upstream path is made smaller than that of any idle roller located on said drive roller downstream path, and wherein said latent image forming apparatus is arranged on said drive roller upstream path.

3. An image forming apparatus according to one of claims 1 and 2, wherein the eccentricity of an idle roller having a greater winding angle of said belt-shaped carrier is smaller than that of an idle roller having a smaller winding angle.

4. An image forming apparatus comprising:

a belt-shaped intermediate transfer member supported for movement on a drive roller, multiple idler rollers and a tension roller;

multiple monochromatic image forming means mounted on said belt-shaped intermediate transfer member, a first transfer apparatus for transferring, to said belt-shaped intermediate transfer member, a plurality of monochromatic toner images formed by said monochromatic image forming means; and a second transfer apparatus for transferring, to a recording medium, a color image obtained by overlaying said plurality of monochromatic toner images;

wherein, when a path leading from said drive roller to said tension roller in the forward direction of movement of said belt-shaped carrier is defined as a drive roller downstream path, and a path leading from said tension roller to said drive roller is defined as a drive roller upstream path, the amount of eccentricity of any idle roller located on said drive roller downstream path is made smaller than that of any idle roller located on said drive roller upstream path, and wherein said latent image transfer point is arranged on said drive roller downstream path.

5. An image forming apparatus comprising:

a belt-shaped intermediate transfer member supported for movement on a drive roller, multiple idler rollers and a tension roller;

multiple monochromatic image forming means mounted on said belt-shaped intermediate transfer member;

a first transfer apparatus for transferring, to said belt-shaped intermediate transfer member, a plurality of monochromatic toner images formed by said monochromatic image forming means; and a second transfer apparatus for transferring, to a recording medium, a color image obtained by overlaying said plurality of monochromatic toner images;

wherein, when a path leading from said drive roller to said tension roller in the forward direction of movement of said belt-shaped carrier is defined as a drive roller downstream path, and a path leading from said tension roller to said drive roller is defined as a drive roller upstream path, the amount of eccentricity of any idle roller located on said drive roller upstream path is made smaller than that of any idle roller located on said drive roller downstream path, and wherein said latent image transfer point is arranged on said drive roller upstream path.

6. An image forming apparatus according to any one of claims 4 and 5, wherein the eccentricity of an idle roller having a greater winding angle of said belt-shaped intermediate transfer member is smaller than that of an idle roller having a smaller winding angle.

7. An image forming apparatus according to any one of claims 1, 2, 4 and 5, further comprising a support member for supporting the rotating shaft of said tension roller in a linearly movable manner in parallel, wherein said support member comprises an elastic member; said image forming apparatus being further characterized in that, when the peripheral length of said belt-shaped carrier or intermediate transfer member is "1", the width is "w", the thickness is "t", Young's modulus is "E", the total of the eccentricities of all rollers which support said belt-shaped carrier or intermediate transfer member is "$\Sigma e$", the maximum permissible image position misregistration is "d" and angles formed by said tension roller traveling direction and the upstream and downstream paths of said belt-shaped carrier or intermediate transfer member is $\alpha$ and $\beta$, respectively, then the spring constant k of said elastic member is expressed as $k<wtE(\cos\alpha+\cos\beta)d/(1\Sigma e)$.

* * * * *